United States Patent [19]

Graziano

[11] Patent Number: 4,648,933

[45] Date of Patent: Mar. 10, 1987

[54] APPARATUS FOR APPLYING STAMPS TO PACKAGES ARRAYED IN CARTONS

[75] Inventor: Lewis R. Graziano, New York, N.Y.

[73] Assignee: American Bank Note Company, New York, N.Y.

[21] Appl. No.: 782,137

[22] Filed: Sep. 30, 1985

[51] Int. Cl.[4] ..... B65C 5/04; B65C 9/02; B65C 9/18; B65C 9/36

[52] U.S. Cl. ..... 156/361; 156/364; 156/366; 156/518; 156/521; 156/530; 156/556; 156/566; 156/583.1; 156/DIG. 2; 156/DIG. 21; 156/DIG. 25; 156/DIG. 33; 156/DIG. 42

[58] Field of Search ..... 156/358, 366, 518, 520, 156/521, 530, 350, 363, 364, 361, 566, 556, 583.1, DIG. 33, DIG. 2, DIG. 21, DIG. 44, DIG. 25, DIG. 27, DIG. 45; 200/6 B, 153 LA, 61.41, 61.42; 269/55–60, 63, 66, 81; 53/201, 67; 493/1, 30

[56] References Cited

U.S. PATENT DOCUMENTS

| | | | |
|---|---|---|---|
| 1,968,881 | 8/1934 | Edwards | 156/584 |
| 2,359,249 | 9/1944 | Scheer | 269/55 |
| 2,429,007 | 10/1947 | Wilske | 493/30 |
| 3,054,237 | 9/1962 | Barkstrom | 53/246 |
| 4,082,595 | 4/1978 | Slater | 156/351 |
| 4,354,894 | 10/1982 | Lewis et al. | 156/517 |

*Primary Examiner*—Donald Czaja
*Assistant Examiner*—J. Davis
*Attorney, Agent, or Firm*—Cooper, Dunham, Griffin & Moran

[57] ABSTRACT

Apparatus for attaching tax stamps to the ends of packages of cigarettes in open cartons. The stamps are fed one at a time from a roll of stamps. The end stamp is cut from the strip and is immediately applied by a heater to the end of a package. The heater remains in contact with the stamp for a preset time. The cartons containing the packages are fed manually. The cutter means and the heater are actuated simultaneously by a switch means which may be operated either manually, or by a cam means which is moved by the carton as it advances past the stamp applying apparatus.

11 Claims, 13 Drawing Figures

Fig. 6.
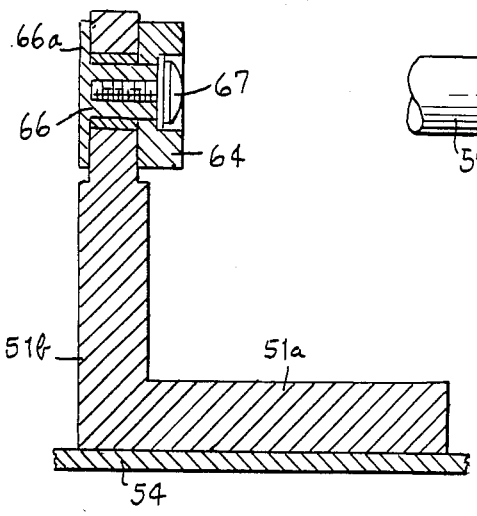
Fig. 8.
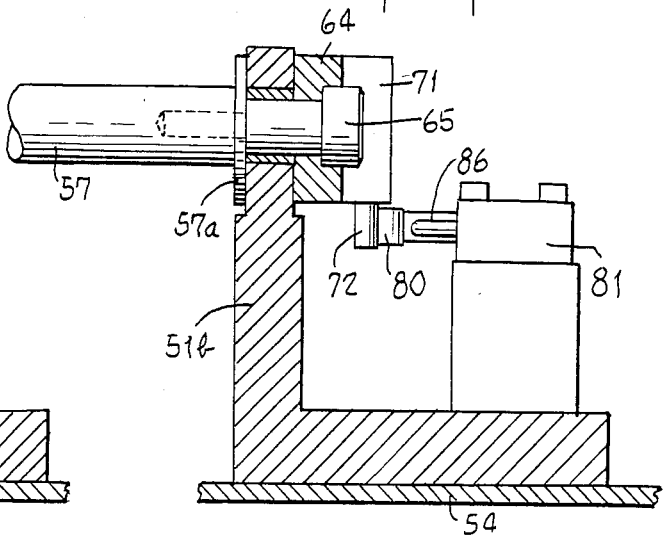
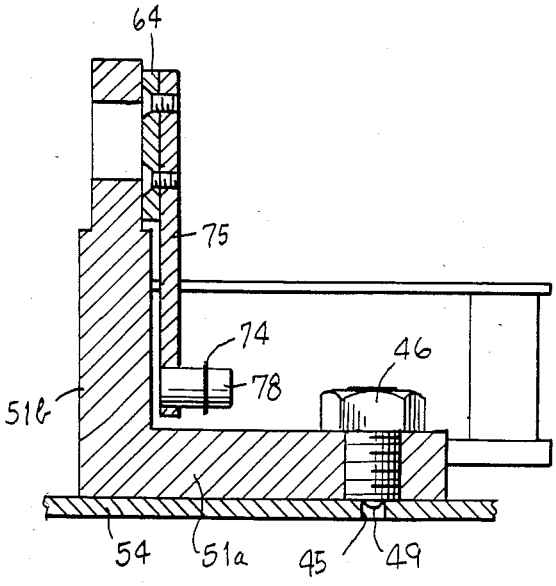
Fig. 7.
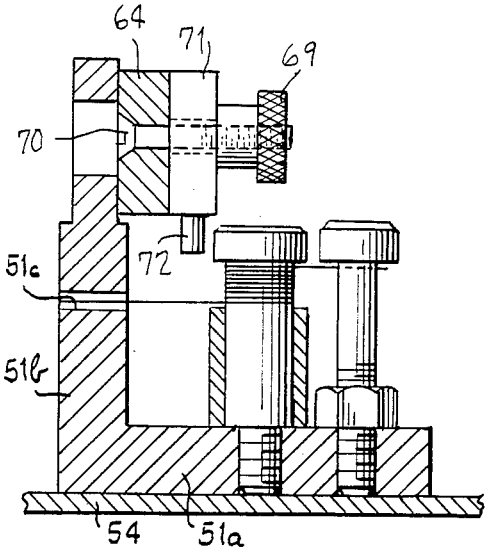
Fig. 9.

Fig. 12.
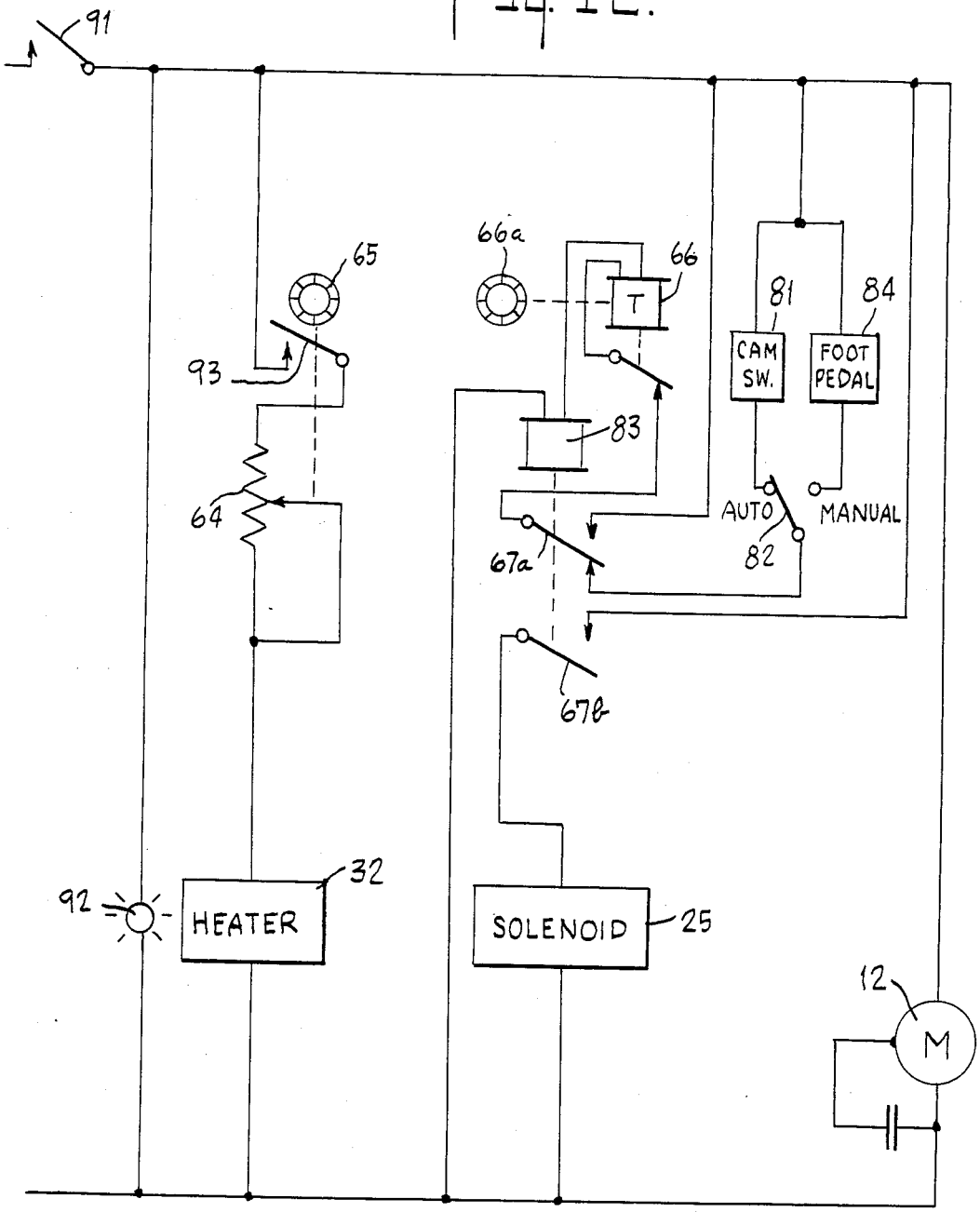
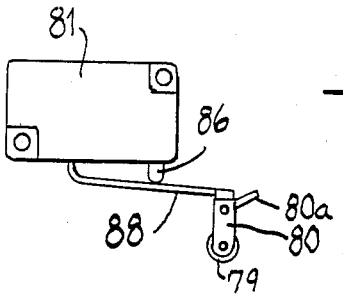
Fig. 13.

APPARATUS FOR APPLYING STAMPS TO PACKAGES ARRAYED IN CARTONS

CROSS-REFERENCE

This invention is an improvement on the invention described and claimed in the copending application of Lewis R. Graziano and Harry V. Kirk, Ser. No. 717,024, filed Mar. 28, 1985, entitled "Stamp Applying Apparatus", which is incorporated herein by reference.

BACKGROUND

The standard type of cigarette carton used in the United States holds ten packages of cigarettes arranged in two parallel rows of five. The longest end dimension of each package extends lengthwise of the carton.

Many brands of cigarettes are on the market with non-standard arrays of packages in cartons. For example, one brand is sold in the carton with one row of ten packages, with the long end dimension of each package crosswise of the carton. Another brand is sold in a carton of twenty packages located in four rows of five packages each.

Cigarette taxes vary considerably between states and between countries. The taxes are usually based on the retail price of the cigarettes. Consequently, the only practical place to apply tax stamps is the premises of a distributor in the state or country where the cigarettes are to be sold at retail. High speed machines are available to apply stamps to cigarette packages in the standard two by five carton, as disclosed in tne copending U.S. patent application of Kimball et al., Ser. No. 587,375, filed Mar. 8, 1984.

The cigarettes in non-standard cartons are commonly sold in considerably lower volume than the standard cartons. The non-standard cartons do not fit in the available high speed automatic tax stamp applying machines. The common practice has been for an employee applying tax stamps to packages in a non-standard carton to use a hand iron in one hand and to supply stamps or decals from a sheet with the other hand. The process is slow and tedious.

The stamp applying apparatus of the Graziano and Kirk application, identified above, is intended for small volume operations, including those employing non-standard or standard cartons. The cartons are moved through the machine by hand. The stamps are fed, one at a time, by a power actuated feed mechanism. The operation of the stamp feeding mechanism is controlled by a manually operated switch. An elongated guide is provided for the cartons of cigarettes being advanced through the machine.

SUMMARY

In accordance with the present invention, a cam operated switch is associated with the guide. That switch controls the stamp feeding mechanism so that it is actuated by the movement or the cartons along the guide. Changeable cams accommodate different arrays of cigarette packages in the cartons. A selector switch is provided so that either the cam operated switch or a manual switch may be used to control the stamp feeding mechanism.

DRAWINGS

FIG. 6 is a sectional view taken on the line 6—6 of FIG. 5.

FIG. 7 is a sectional view taken along the line 7—7 of FIG. 4, with the carton of cigarettes omitted.

FIG. 8 is a sectional view taken along the line 8—8 of FIG. 5.

FIG. 9 is a sectional view taken along the lrne 9—9 of FIG. 5.

FIG. 12 is a wiring diagram of the electrical circuit of tne stamp applying mechanism.

FIG. 13 is a plan view of a cam operated switch and its actuating means, removed from the rest of the apparatus.

DETAILED DESCRIPTION

Figure 1:
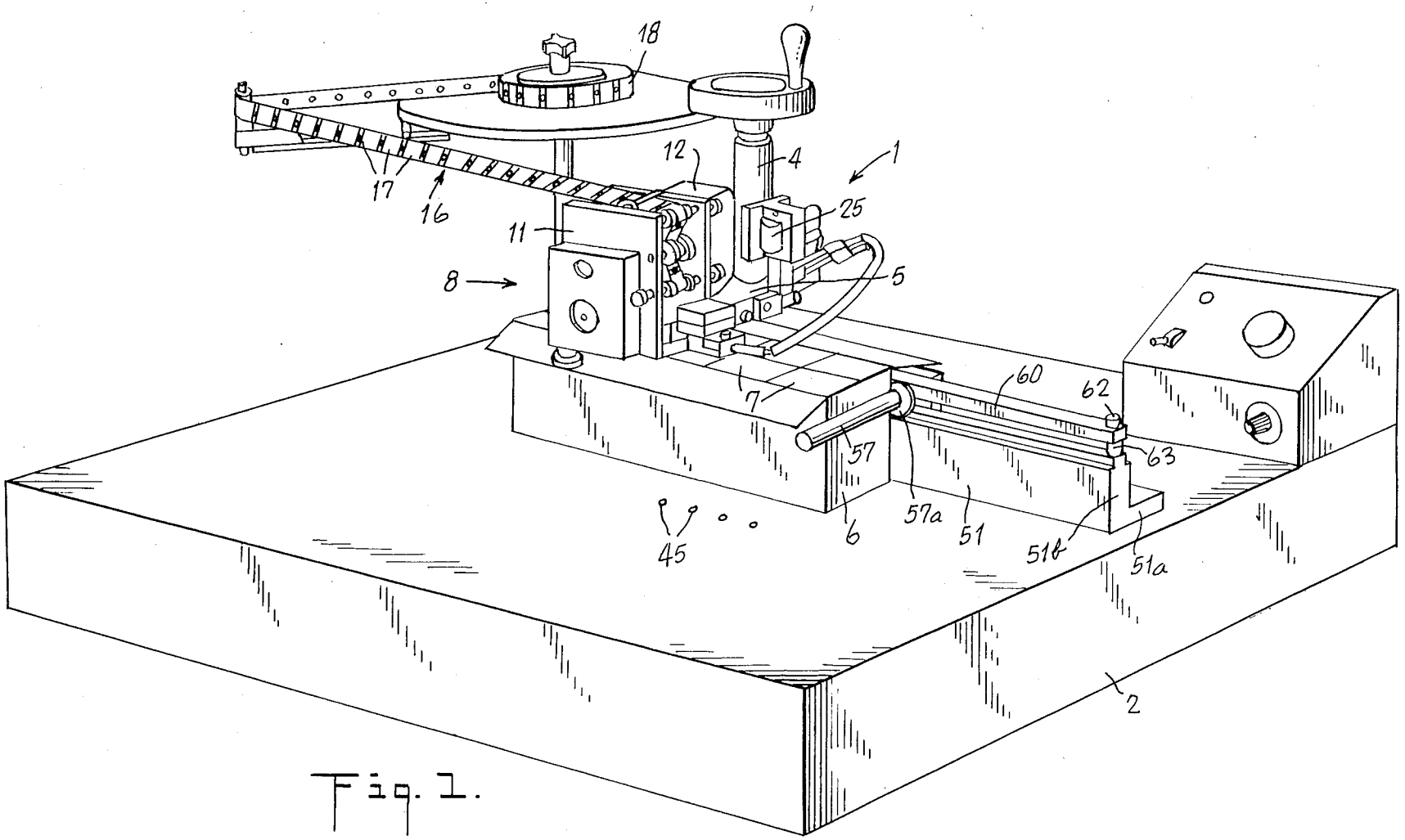
FIG. 1 is a perspective view of apparatus embodying the invention.

The apparatus of this figure includes a stamp feeding mechanism shown by the reference numeral 1, which is the same as that shown in the copending Graziano and Kirk application cited above and incorporated herein by reference. The stamp feeding mechanism 1 is described herein to show how it cooperates with the carton guiding mechanism and the control mechanism of the present invention. The stamp feeding mechanism 1 is mounted on a base 2, which is intended to rest on a work table. A post 4 is fastened to the base 2. An arm 5 is supported on the post 4 and may be raised and lowered by a screw thread operated by a hand crank at the top of the post. The arm 5 carries an operating head including a frame 8 supporting an electric motor 12 which drives the stamp advancing mechanism to feed one stamp at a time, by means of a one-revolution clutch, as described in the Graziano and Kirk application. The stamps are fed in a strip 16 consisting of individual stamps 17, which are coated on their under side with heat activatable adhesive.

The arm 5 also supports, by means of a bracket 20 (FIG. 2), a solenoid 25 which drives an armature 26 connected through a link 30 to an arm 27 fixed on a shaft 28. Another arm 29 fixed on shaft 28 carries a cutter blade (not shown) and a combined presser foot and heater 32. The heater 32 directly engages one of the stamps 17 and holds it against the top of a package 7 of cigarettes.

A guide rail 51 of L-shaped cross-section, has a horizontal flange **51*a* which rests on the base 2, and a vertical flange 51*b* extending upwardly from the base 2. The guide rail 51 is fastened to the base 1 by means of a locking knob 52 and a pair of detents 49 (FIG. 7). The knob 52 is fixed on a shaft 53 which extends through one of a series of holes 54*a* in a top plate 54 of the base 2 and thence through an aligned hole in a reinforcement plate 55 fastened to the underside of the plate 54**. Under the plate 55, the shaft 53 carries a transversely extending pin 53*a*.

Each of the holes 54*a* is in the middle of a slot 54*b* which allows passage of the pin 53*a* when it is desired to change tne position of the guide 51. The plate 55 is provided with similar slots for the same purpose.

Figure 2:
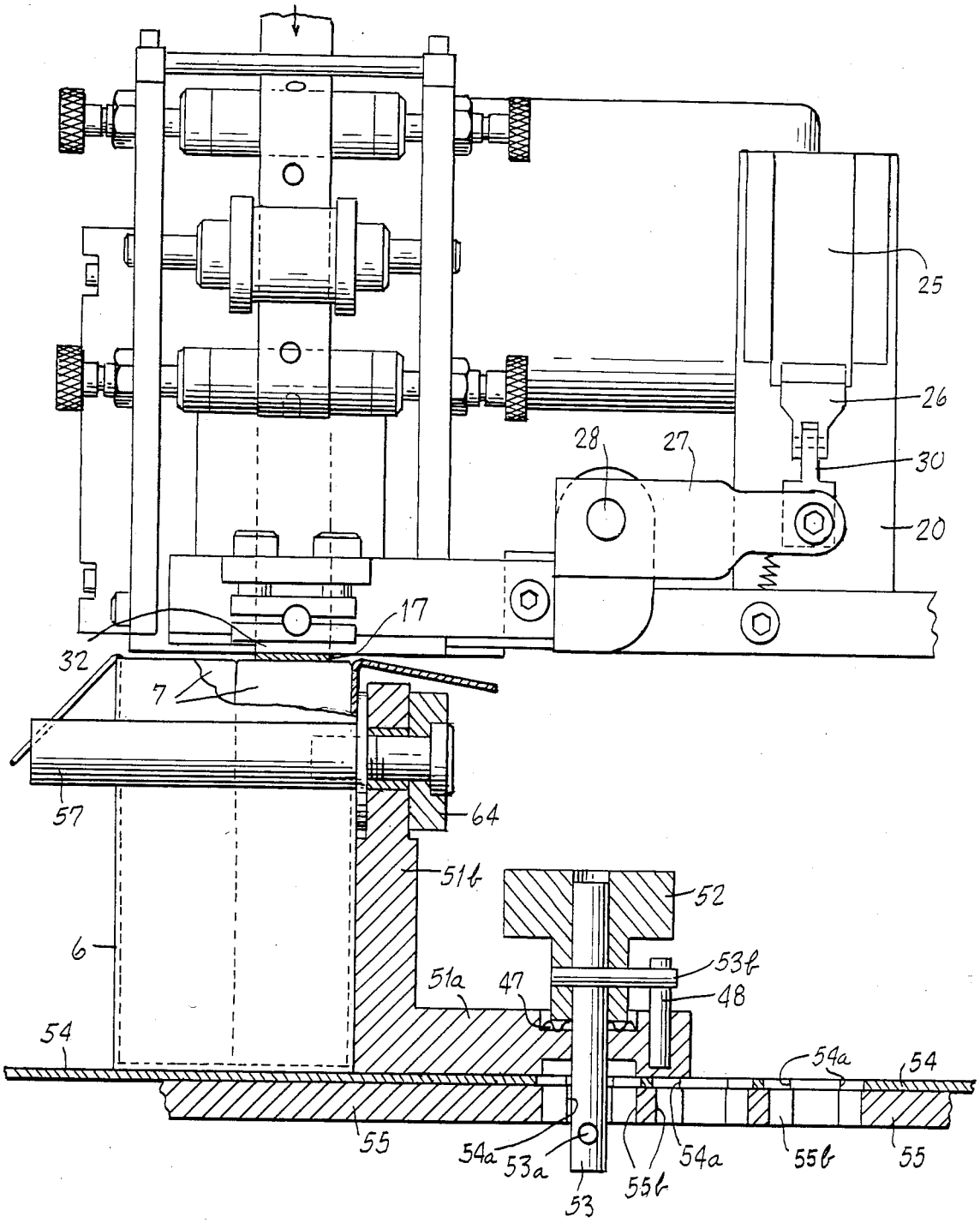
FIG. 2 is a fragmentary view of the apparatus of FIG. 1, partly in right-hand elevation and partly in section on the line 2—2 of FIG. 3.

Above the flange 51*a*, another pin 53*b* extends tnrough the knob 52 and shaft 53 in a direction at right angles to pin 53*a*. Rotation of knob 52 is limited by a pair of pins 48 extending upwardly from the flange 51*a*. One of the pins 48 is shown in FIG. 2. The pins 48 are located so as to engage pin 53*b* and thereby to limit the rotation of knob 52 to about 90°. A spring washer 47 is captured between knob 52 and flange 51*a*, and biases the knob upwardly so that pin 53*a* engages the under side of plate 55.

Figure 3:
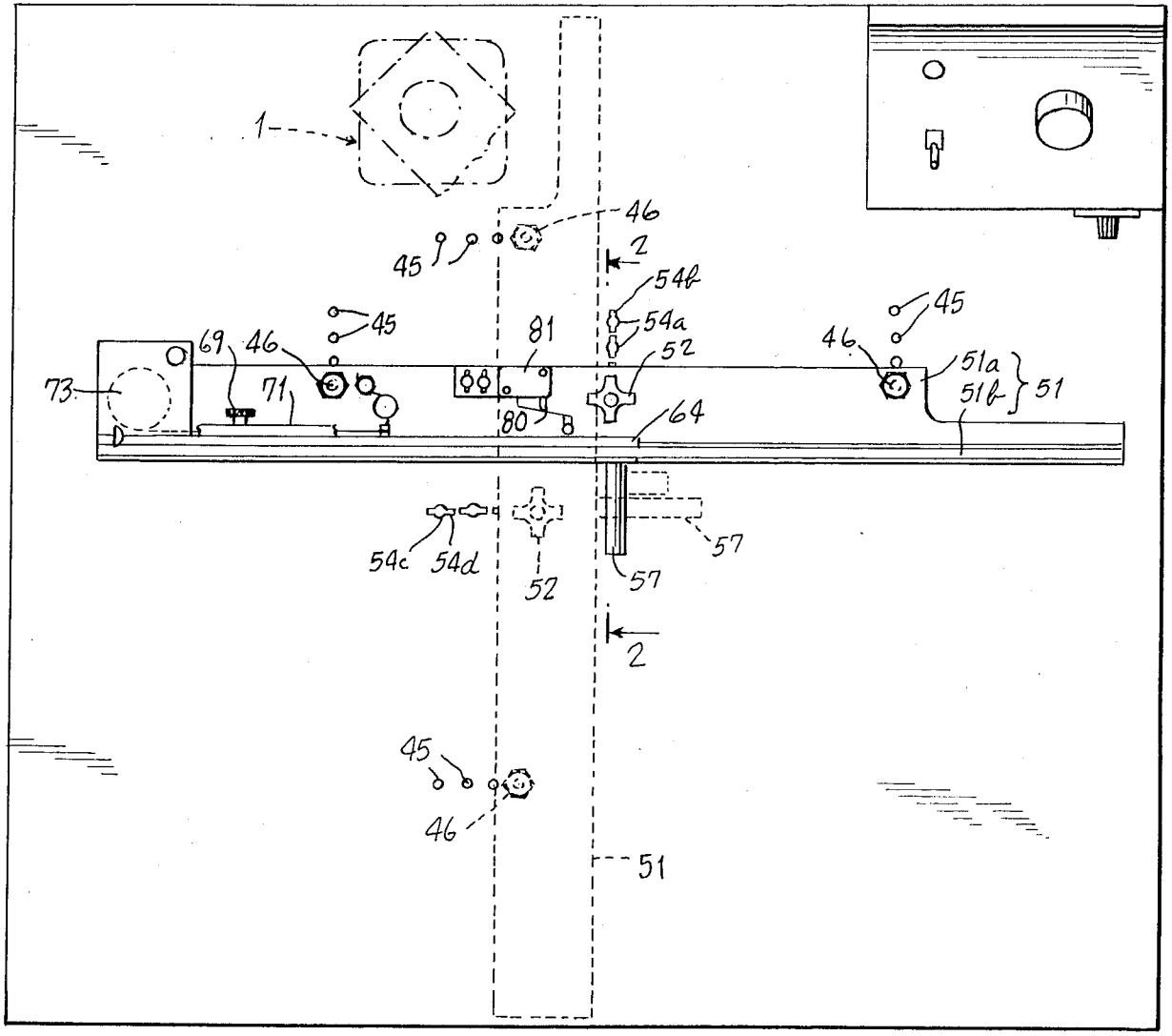
FIG. 3 is a plan view of the guide and cam means of the present invention with certain parts broken away, and with a second position of the guide and cam means shown in dotted lines.

By depressing the knob 52 against the spring washer 47, the knob 52 may be rotated to bring the pin 53*a* into alignment with the slot 54*b*. The knob 42 may then be lifted to take the shaft 53 and pin 53*a* out of the plate 54. The guide rail 51 may then be shifted to any other position where tne plate 54 is provided with a hole and slot to accommodate the shaft 53 and pin 53*a*. A first set of holes 54*a*, each in a slot 54*b*, are spaced vertically apart as they appear in FIG. 3. A second set of holes 54*c*, each in a slot 54*d*, is provided to allow setting of the guide rail 51 in any of a range of positions (such as the dotted line position of FIG. 3) perpendicular to the position shown in full lines.

The detents 49, best seen in FIG. 7, are rounded projections extending downward from screws 46, threaded into the flange 51*a*. In operation, each detent fits into one of a set of four holes 45. Four sets of holes 45 are provided, two sets for each of the two ranges of positions which the guide 51 may assume.

Figure 4:
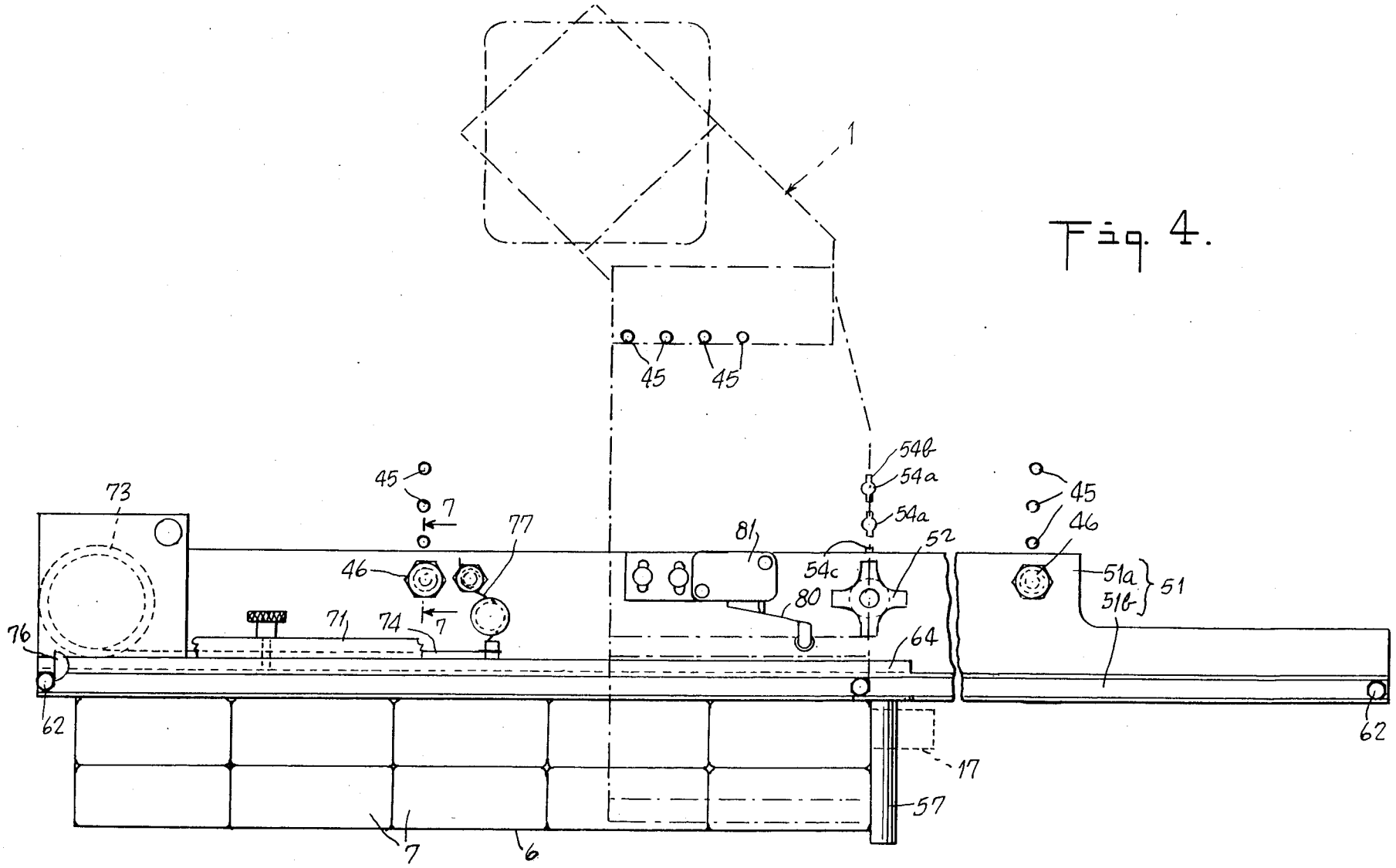
FIG. 4 is a view similar to FIG. 3, but on a larger scale, showing the guide and cam means in only one position, and showing certain other parts of the apparatus in dotted lines, with a carton of cigarettes in position to move through the apparatus.
Figure 5:
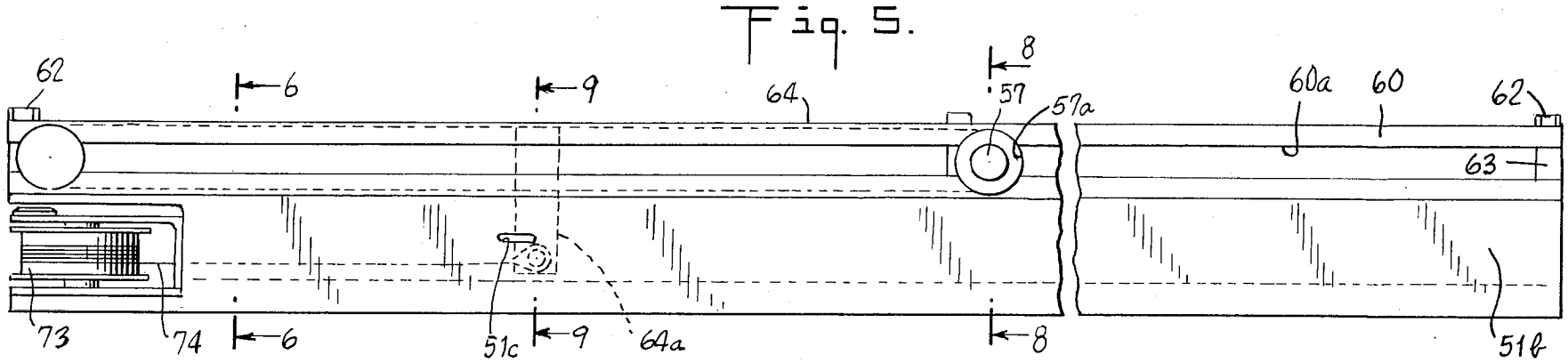
FIG. 5 is an elevation of the guide means shown in FIG. 4.
Figure 10:
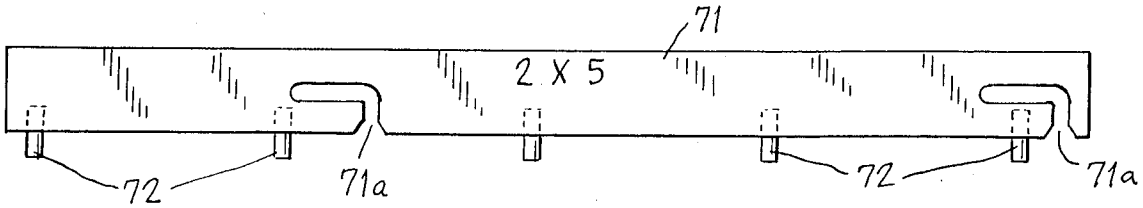
FIG. 10 is an elevational view of a typical cam.

A carton 6 of cigarette packages is placed against tne vertical flange 51*b* of the guide rail 51, in the position shown in FIG. 4. A track bar 60 (FIG. 5) is mounted above the top of the vertical flange 51*b*. At each end of the flange 51*b*, a bolt 62 extends through the track bar 60 and a spacer 63 and is threaded into the upper end of the flange 51*b*. A slot 60*a* is defined by the track bar 60 and the top of the flange 51*b*. The right-hand end of the carton, as shown in FIG. 4, which is the advancing end, engages an arm 57 which is part of a cam means movable along the slot 60*a*. The cam means also includes a cam mounting bar 64 and a cam 71. A screw 65 (FIG. 8) extends through the cam mounting bar 64 at its right-hand end, as viewed in FIGS. 4 and 5. The inner end of the screw 65 threadedly engages the inner end of the arm 57, which is provided with a flange 57*a* which slides along the track bar 60 and the flange 51*b*. The other end of the cam mounting bar 64 is held in place in the slot 60*a* by a support pin 66 (FIG. 6) having a flange 66*a* which also slides along the outside of the track bar 60 and the rail flange 51*b*. The pin 66 has a shank which extends through the slot 60*a* and is engaged by a screw 67. The cam mounting bar 64 carries a pair of spaced screws 70, shown in FIG. 9. Each screw 70 has a tapered head received in the bar 64, and a shank which is threaded into the mounting bar 64 and extends freely through a cam 71. The opposite end of the screw 70 threadedly receives a knob 69 for holding the cam 71 in place. The cam 71 is provided on its under side with a series of five pins 72 (FIGS. 9 and 10) corresponding to the number of packages of cigarettes found in one row in the particular carton being moved through the apparatus. The cam 71 has a pair of L-shaped slots 71*a* formed in its lower edge. The stems of the L-shaped slots are adapted to slide over the screws 70 on the cam support bar 64. The crossbars of the slots 71*a* allow a limited amount of endwise adjustment of the cam 71 on the cam support bar 64, after tne screws 70 reach the upper end of the stems of the slots 71*a*. The knobs 69 may then be tightened to fasten the cam 71 in place.

A spring reel 73 is mounted at the left-hand end of the flange 51*a* of guide rail 51. A cable 74 is wound around the spring reel and has its free end extending along the cam mounting bar 64. A connector plate 75 (FIG. 7) is fastened in a recess 64*a* in cam mounting bar 64 and has its lower end projecting downwardly along the flange 51*b*. The connector plate 75 carries at its lower end a pin 78. The free end of the cable 74 is bent over to engage the pin 78. The spring reel 73, acting through cable 74, biases the cam mounting bar and its assembled parts to the left-hand end of its travel, as shown in FIG. 4 where its left-hand end engages a resilient bumper stop 76 fixed in the spacer 63. A shock absorbing spring 77 may also be provided, having a projecting end which engages a slot 51*c* (FIG. 5) formed in the flange 51*b* of the guide rail 51.

The pins 72 on the cam 71 engage a roller 79 (FIG. 13) rotatably mounted on the end of an arm 80, which is in turn pivoted on the end of an actuating lever 88 of a switch 81. The lever 88 is flexible, and is in engagement with a button 86 that actuates the switch 81. A tab 80*a* on the arm 80 engages the end of lever 88 so as to limit the counter clockwise movement of arm 80 on its pivot. Any equivalent alternative arrangement may be used to limit the movement of arm 80. A torsion spring (not shown) biases the arm 80 to the position shown, where the tab 80*a* is engaging the end of lever 88. As a cigarette package moves into a position aligned with the stamp applying head, one of the pins 72, moving to the right as viewed in FIGS. 4 and 13, engages the roller 79. Since that roller cannot move to the right, the flexible lever 88 is deflected upwardly, pushing the button 86 and actuating the switch 81 from a normally open position to a closed position by actuating the push button 86 (FIG. 13). This causes the stamp applying head to deposit a stamp on the top of the cigarette package and hold it there for a fraction of a second, long enough for the adhesive to be activated. If the operator is moving the carton manually, he stops the motion briefly after each actuation of the stamp applying mechanism to allow time for activation of the adhesive. The operator continues to move the carton of cigarettes along and the switch actuation is coordinated with the package positions by the pins 72 engaging the roller 79.

Figure 11:
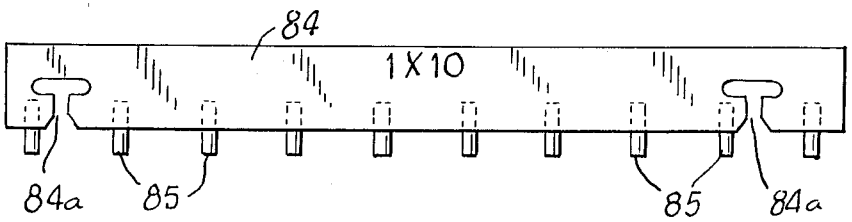
FIG. 11 is a similar view of another cam.

FIG. 11 shows a cam 84 which has ten pins on its under surface and is intended for use with cigarette cartons having one row of ten packages. The cam 84 is shown with T-shaped slots 84*a* instead of L-shaped slots as in the cam 71 of FIG. 10. The selection of slot shape is a matter of choice, as long as the operator is allowed some longitudinal adjustment of the cam position.

The wiring diagram for the apparatus is shown in FIG. 12. A selector switch 82 is manually shiftable between two positions, one of which places the switch 81 in control of the timing relay 83. In the other position, a manually operated switch 34 is placed in control of the timing relay 83. The other parts of the circuit may be the same as those of the circuit shown in the copending application of Graziano and Kirk, Ser. No. 717,024, identified above.

FIG. 12—OPERATION

A main switch 91 (FIG. 12) is first closed, energizing the motor 12 and a "power on" light 92 in parallel with the motor. The switch 91 also completes a circuit through the heater 32 and a variable resistance 64 connected in series. Variation of that resistance sets the temperature at the heater 32. The resistance 64 may be connected in series with a switch 93, operated by the same manual control that varies the resistance 64. The switch 64 controls the circuit through heater 32. If desired, the temperature at that heater may be controlled by a thermostat, which may be adjusted to set the temperature.

After the heater 32 has attained the desired temperature, a carton containing packages to be stamped is moved along the guide 51, so that the leading package moves under the heater and below the projecting end stamp. If the switch 82 is in its automatic position, as shown, then the leading pin 72 on the cam 71 closes the switch 81, which completes a circuit for energizing a timer 66 and the relay 83, shown as connected in series. The relay 67 closes front contacts 67*a* and 67*b*. Contact 67*a* completes a stick circuit for relay 67 and opens the circuit through the switch 81, taking that switch out of control.

Contact 67*b* completes a circuit for the solenoid 25, which operates the cutter means to sever the end stamp from the strip. At the same time, the heater 32 is moved downwardly to engage that severed stamp and hold it against the package being stamped. Relay 83 is maintained energized and the heater 32 is held in engagement with the stamp for a time determined by the setting of timer 66, which may be varied by means of a knob 66*a*, and is usually a fraction of a second. Other equivalent means may be employed to keep relay 83, and hence solenoid 25, energized for a predetermined time, so that the actuation of the solenoid will be maintained for the proper time. Actuation of the solenoid 25 for too long or too short a time should be prevented. Since the switch 81 is controlled manually by movement of the carton, its period of closure is subject to variation.

When a carton of cigarettes is being moved through tne apparatus toward the right, as viewed in FIGS. 4 and 13, each pin 72 engages the roller 79. The operating lever 80 is deflected, engaging the button 86 and closing the switch 81. After the carton 6 has reached the limit of its travel to the right, so that all of the packages in one row have been stamped, the carton is removed, allowing the cam means, including the arm 57, the cam mounting bar 64 and the cam 71, to move backward to their original positions. During the backward movement (right-to-left in FIGS. 4 and 13), the pins 72 strike the right-hand side of the roller 71, but the torsion spring allows arm 80 to turn clockwise on its pivot so that the return movement of the pins 72 does not move the arm 80 and actuate the switch 81.

The carton of cigarettes is then rotated end-for-end to bring the second row of packages into alignment with the stamps 17 and the process is repeated to apply stamps to the second row.

I claim:

1. Apparatus for affixing a stamp having its back coated with adhesive to each of a plurality of packages aligned in a row in an upwardly open carton, comprising:

(a) presser means, movable between an upper inactive position and a lower active position, for pressing a stamp against an upwardly facing surface of a package in a carton as aforesaid;

(b) means, providing a stationary carton support surface spaced below the active position of said presser means, for supporting an upwardly open carton containing a plurality of packages aligned in a row as aforesaid to be stamped while enabling the carton to be advanced longitudinally across the support surface along a rectilinear path such that the upwardly facing surfaces of the packages in the last-mentioned row are brought successively into register with the active position of the presser means;

(c) means for feeding stamps, one at a time, to a position adjacent the active position of said presser means for application by said presser means to an upwardly facing package surface in register with said active position;

(d) means for guiding the carton along said path to bring the upwardly facing surfaces of the packages in the last-mentioned row successively into register with the active position of the presser means, said guiding means comprising a stationary guide member extending parallel to said path for engaging a side surface of the carton as the carton advances in said path;

(e) cam means supported by the guide member for sliding movement therealong parallel to said path and having a portioin projecting into said path to engage the leading end of the carton as the carton advances in the path such that the cam means moves with the carton along the guide member toward the presser means active position;

(f) switch means engageable by and operated by the cam means, said cam means being coordinated with locations of packages in the carton for operatively engaging the switch means, during advance of the carton in the path, each time a package in the last-mentioned row is advanced into register with the presser means active position; and (d) means operated by the switch means, each time the switch means is operatively engaged by the cam means, to move the presser means from inactive to active position for pressing the adjacent stamp against the upwardly facing surface of a package in register with said active position whereby the stamp is affixed to the package, and thereafter to restore the presser means to its inactive position while activating the feeding means to feed another stamp to a position adjacent the presser means active position.

2. Apparatus as defined in claim 1, wherein said cam means moves in one direction along said path as the carton advances in the path, and is movable in an opposite direction along said path, after the carton is removed from the path, for restoration of the cam means to a starting position for engagement with an advancing carton; and wherein said switch means is engageable by said cam means during movement of said cam means in either of said directions but is operated only by engagement with the cam means during movement of the cam means in said one direction.

3. Apparatus as defined in claim 2, wherein said cam means includes a plurality of pins, at least equal in number to the number of packages in said last-mentioned row and spaced apart along said path by distances equal to the extent of advance of the carton in the path between positions at which two successive packages in the last-mentioned row are respectively in register with said presser means active position, for successively operatively engaging the switch means during advance of the carton in the path as aforesaid.

4. Apparatus as defined in claim 3, wherein said cam means comprises a cam mounting bar supported by said guide member for sliding movement as aforesaid and bearing said portion projecting into said path, and a cam member to which said pins are fixedly secured, said cam member being removeably mounted on said mounting bar so as to be replaceable with another cam member to which pins of a different number and/or spacing are secured.

5. Apparatus as defined in claim 2, wherein said cam means includes resilient means urging said cam means toward said starting position for restoring said cam means to said starting position upon release of said cam means portion from engagement with the leading edge of the carton.

6. Apparatus as defined in claim 1, further including manually operable switch means and a selector switch for placing either the manually operable switch means or the cam operated switch means in control of the means for moving the presser means.

7. Apparatus as defined in claim 1, wherein said guiding means, together with said cam means and said switch means, are selectively mountable on said carton-supporting surface at any of a plurality of positions respectively defining different paths of carton advance.

8. Apparatus as defined in claim 7 wherein said different paths include at least two aligned paths of respectively different widths.

9. Apparatus as defined in claim 7, wherein said different paths include at least two paths oriented perpendicularly to each other.

10. Apparatus as defined in claim 1, for use with stamps having a heat-activatable adhesive, wherein said presser means includes means for heating a stamp to an adhesive-activating temperature as the presser means presses the stamp against an upwardly facing package surface; and wherein said means for moving the presser means includes timer means, actuated each time the means for moving the presser means is operated, for maintaining the presser means in pressing engagement with a stamp at the active position for a predetermined period effective to adhere the stamp to a package.

11. Apparatus as defined in claim 1, for use with stamps arranged end to end in a continuous strip, wherein said feeding means comprises means for feeding said strip to deliver the stamp at the leading end of the strip to the aforesaid position adjacent the presser means active position and further including cutter means having a cutter element carried with the presser means for severing the leading-end stamp from the strip as the presser means moves from inactive to active position.

* * * * *